US010030452B2

(12) United States Patent
Azar et al.

(10) Patent No.: US 10,030,452 B2
(45) Date of Patent: Jul. 24, 2018

(54) CUTTING STRUCTURES FOR FIXED CUTTER DRILL BIT AND OTHER DOWNHOLE CUTTING TOOLS

(71) Applicant: SMITH INTERNATIONAL, INC., Houston, TX (US)

(72) Inventors: Michael G. Azar, The Woodlands, TX (US); Bala Durairajan, Sugar Land, TX (US); Madapusi K. Keshavan, The Woodlands, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 100 days.

(21) Appl. No.: 14/206,228

(22) Filed: Mar. 12, 2014

(65) Prior Publication Data

US 2014/0262544 A1 Sep. 18, 2014

Related U.S. Application Data

(63) Continuation of application No. 61/782,980, filed on Mar. 14, 2013.

(51) Int. Cl.

| | |
|---|---|
| ***E21B 10/567*** | (2006.01) |
| ***E21B 10/55*** | (2006.01) |
| ***E21B 10/43*** | (2006.01) |

(52) U.S. Cl.

CPC ..... *E21B 10/5673* (2013.01); *E21B 10/43* (2013.01); *E21B 10/55* (2013.01)

(58) Field of Classification Search

USPC ..... 175/430

See application file for complete search history.

(56) References Cited

U.S. PATENT DOCUMENTS

| | | | | |
|---|---|---|---|---|
| 4,104,344 | A | 8/1978 | Pope et al. | |
| 4,288,248 | A | 9/1981 | Bovenkerk et al. | |
| 4,602,691 | A * | 7/1986 | Weaver | E21B 10/43 175/430 |
| 4,872,520 | A | 10/1989 | Nelson | |
| 5,127,923 | A | 7/1992 | Bunting et al. | |

(Continued)

FOREIGN PATENT DOCUMENTS

| | | |
|---|---|---|
| CN | 2297177 Y | 11/1998 |
| CN | 2732975 Y | 10/2005 |

(Continued)

OTHER PUBLICATIONS

International Search Report and Written Opinion issued in PCT/US2014/025279 dated Jul. 21, 2014, 23 pages.

(Continued)

*Primary Examiner* — Taras P Bemko

(57) ABSTRACT

A cutting tool may includes a tool body; a plurality of blades extending from the tool body; and a plurality of non-planar cutting elements disposed along each of the plurality of blades, the plurality of non-planar cutting elements form a cutting profile, in a rotated view of the plurality of non-planar cutting elements into a single plane, the cutting profile including a cone region, a nose region, a shoulder region, and a gage region. The plurality of non-planar cutting elements include a first shape in at least one of the cone region, nose region, shoulder region, and gage region, and a second, different shape in at least one other region.

24 Claims, 9 Drawing Sheets

(56) References Cited

U.S. PATENT DOCUMENTS

| | | | |
|---|---|---|---|
| 5,549,171 | A | 8/1996 | Mensa-Wilmot et al. |
| 5,752,573 | A | 5/1998 | Scott et al. |
| 5,871,060 | A | 2/1999 | Jensen et al. |
| 5,881,830 | A | 3/1999 | Cooley |
| 6,003,623 | A | 12/1999 | Miess |
| 6,021,859 | A | 2/2000 | Tibbitts et al. |
| 6,148,937 | A | 11/2000 | Mensa-Wilmot et al. |
| 6,176,333 | B1 | 1/2001 | Doster |
| 6,241,035 | B1 | 6/2001 | Portwood |
| 6,330,924 | B1 | 12/2001 | Hall |
| 6,332,503 | B1 | 12/2001 | Pessier et al. |
| 6,427,792 | B1 | 8/2002 | Roberts et al. |
| 6,499,547 | B2 | 12/2002 | Scott et al. |
| 6,510,910 | B2 | 1/2003 | Eyre et al. |
| 7,234,550 | B2 | 6/2007 | Azar et al. |
| 7,360,608 | B2 | 4/2008 | Brackin et al. |
| 7,455,125 | B2 | 11/2008 | Sinor et al. |
| 7,533,738 | B1 | 5/2009 | Hall et al. |
| 7,690,442 | B2 | 4/2010 | Portwood et al. |
| 7,690,971 | B2 | 4/2010 | Sung |
| 7,726,420 | B2 | 6/2010 | Shen et al. |
| 7,757,785 | B2 | 7/2010 | Zhang et al. |
| 8,087,478 | B2 | 1/2012 | Patel |
| 8,109,346 | B2 | 2/2012 | Mensa-Wilmot |
| 8,127,863 | B2 | 3/2012 | Durairajan et al. |
| 8,172,008 | B2 | 5/2012 | Dykstra et al. |
| 8,567,532 | B2 | 10/2013 | Hall et al. |
| 2005/0269139 | A1 | 12/2005 | Shen et al. |
| 2006/0180356 | A1 | 8/2006 | Durairajan et al. |
| 2007/0062736 | A1 | 3/2007 | Cariveau et al. |
| 2007/0079995 | A1* | 4/2007 | McClain ..... E21B 10/43 175/426 |
| 2007/0215389 | A1 | 9/2007 | Da Silva et al. |
| 2007/0278017 | A1 | 12/2007 | Shen et al. |
| 2008/0035380 | A1 | 2/2008 | Hall et al. |
| 2008/0035387 | A1 | 2/2008 | Hall et al. |
| 2008/0142275 | A1* | 6/2008 | Griffin ..... E21B 10/567 175/425 |
| 2008/0264696 | A1 | 10/2008 | Dourfaye et al. |
| 2010/0059287 | A1 | 3/2010 | Durairajan et al. |
| 2010/0059289 | A1 | 3/2010 | Hall et al. |
| 2010/0065332 | A1 | 3/2010 | Hall et al. |
| 2010/0155149 | A1 | 6/2010 | Keshavan et al. |
| 2010/0219001 | A1 | 9/2010 | Shen et al. |
| 2010/0263939 | A1 | 10/2010 | Hall et al. |
| 2010/0307829 | A1* | 12/2010 | Patel ..... E21B 10/5673 175/57 |
| 2011/0000714 | A1* | 1/2011 | Durairajan ..... E21B 10/55 175/57 |
| 2011/0100724 | A1 | 5/2011 | Azar |
| 2011/0155472 | A1 | 6/2011 | Lyons et al. |
| 2011/0192651 | A1 | 8/2011 | Lyons et al. |
| 2011/0266070 | A1 | 11/2011 | Scott et al. |
| 2012/0031674 | A1 | 2/2012 | Lyons |
| 2012/0205163 | A1 | 8/2012 | Azar et al. |
| 2012/0234610 | A1 | 9/2012 | Azar et al. |
| 2012/0247834 | A1 | 10/2012 | Buxbaum et al. |
| 2013/0075166 | A1 | 3/2013 | Cox |
| 2013/0112485 | A1 | 5/2013 | Richert et al. |
| 2013/0292185 | A1 | 11/2013 | Knull et al. |

FOREIGN PATENT DOCUMENTS

| | | | |
|---|---|---|---|
| CN | 1734054A | A | 2/2006 |
| CN | 2777175 | Y | 5/2006 |
| CN | 2828298 | Y | 10/2006 |
| CN | 200964797 | Y | 10/2007 |
| CN | 201024900 | Y | 2/2008 |
| CN | 201334873 | Y | 10/2009 |
| CN | 201396071 | Y | 2/2010 |
| CN | 201513124 | U | 6/2010 |
| CN | 201526273 | U | 7/2010 |
| CN | 201588550 | U | 9/2010 |
| CN | 201771431 | U | 3/2011 |
| CN | 201943584 | U | 8/2011 |
| CN | 202176265 | U | 3/2012 |
| GB | 2328233 | A | 2/1999 |
| GB | 2428840 | A | 2/2007 |
| RU | 2315850 | C1 | 1/2008 |
| WO | 2012109517 | A1 | 8/2012 |

OTHER PUBLICATIONS

International Search Report and Written Opinion issued in PCT/US2014/025294 dated Aug. 14, 2014, 22 pages.

"PDC inserts", Hunan Feiray Composite Material Co., Ltd., Retrieved from the Internet: http://perfect-pdc.en.made-in-china.com/product/woRQOXnJHIVr/China-PDC-Inserts.html, Accessed Jun. 2, 2014, 3 pages.

Crowe, et al., "A new effective method of maintaining "hole gauge" using synthetic diamond enhanced inserts on downhole drilling tools", Society of Petroleum Engineers, SPE/IADC Middle East Drilling Technology Conference, Abu Dhabi, United Arab Emirates, Nov. 8-10, 1999, 11 pages.

Keshavan, et al., "Diamond-Enhanced Insert: New Compositions and Shapes for Drilling Soft-to-Hard Formations", SPE 25737—SPE/IADC Drilling Conference, Amsterdam, Netherlands, Feb. 22-25, 1993, 15 pages.

Mensa-Wilmot, et al., "Innovative cutting structure, with staged rop and durability characteristics, extends PDC bit efficiency into chert/pyrite/conglomerate applications", SPE 105320-MS—SPE Middle East Oil and Gas Show and Conference, Kingdom of Bahrain, Mar. 11-14, 2007, 9 pages.

Wise, et al., "Geometry and material choices govern hard-rock drilling performance of PDC drag cutters", Alaska Rocks, The 40th U.S. Symposium on Rock Mechanics (USRMS), Anchorage, AK, Jun. 25-29, 2005.

First Office Action issued in related CN application 201480014746.6 dated May 30, 2016, 18 pages.

Office Action issued in related RU application 2015143598 dated Jun. 27, 2016, 13 pages.

Third Office Action issued in Chinese Patent Application No. 201480014746.6 dated May 27, 2017, 21 pages.

Decision on Grant issued in Russian Patent Application No. 2015143435 dated Apr. 21, 2017.

Decision on Grant issued in Russian Patent Application No. 2015143598 dated Apr. 21, 2017.

Office Action issued in U.S. Appl. No. 14/206,280 dated Mar. 7, 2017.

Office Action issued in U.S. Appl. No. 14/613,144 dated Dec. 29, 2016.

Office Action issued in U.S. Appl. No. 14/206,280 dated Aug. 3, 2017, 17 pages.

Office Action issued in U.S. Appl. No. 14/613,144 dated Aug. 9, 2017, 19 pages.

Decision of Rejection issued in Chinese Patent Application No. 201480014751.7 dated Aug. 31, 2017, 17 pages.

First Office Action issued in related Chinese Patent Application No. 201480014751.7 dated Jun. 1, 2016, 19 pages.

Office Action issued in related Russian Patent Application No. 2015143435 dated Sep. 9, 2016. 5 pages.

Office Action issued in related Russian Patent Application No. 2015143598 dated Oct. 20, 2016, 4 pages.

International Search Report and Written Opinion issued in related International Patent Application No. PCT/US2015/014561 dated May 29, 2015, 20 pages.

International Preliminary Report on Patentability issued in related International Patent Application No. PCT/US2014/025279 dated Sep. 24, 2015, 15 pages.

International Preliminary Report on Patentability issued in related International Patent Application No. PCT/US2014/025294 dated Sep. 24, 2015, 14 pages.

International Preliminary Report on Patentability issued in related International Patent Application No. PCT/US2015/014561 dated Sep. 22, 2016, 13 pages.

Fan et al., "Mechanism of the effect of interface structure on the abrasion performance of polycrystalline diamond compact", 2011, Advanced Materials Research vol. 230-232, pp. 669-673.

(56) References Cited

OTHER PUBLICATIONS

Second Office Action issued in related Chinese application 201480014746.6 dated Jan. 16, 2017, 19 pages.
"PDC cutter/Sharp-edge PDC cutters/Synthetic polycrystalline diamond", retrieved from http://3bdiamond.en.alibaba.com/product/694306890-215141609/PDC_cutter_Sharp_edge_PDC_cutters_Synthetic_polycrystalline_diamond.html>, accessed Jun. 26, 2014; 4 pages.
First Office Action and Search Report issued in Chinese Patent Application No. 201580024812.2 dated Feb. 1, 2018, 15 pages.

* cited by examiner

CUTTING STRUCTURES FOR FIXED CUTTER DRILL BIT AND OTHER DOWNHOLE CUTTING TOOLS

CROSS-REFERENCE TO RELATED APPLICATION

This application claims priority to and the benefit of related U.S. Provisional Application No. 61/782,980, filed on Mar. 14, 2013, entitled, "CUTTING STRUCTURES FOR FIXED CUTTER DRILL BIT AND OTHER DOWNHOLE CUTTING TOOLS" to inventor Azar et al., the entire contents of which is fully incorporated herein by reference.

BACKGROUND

In drilling a borehole in the earth, such as for the recovery of hydrocarbons or for other applications, it is conventional practice to connect a drill bit on the lower end of an assembly of drill pipe sections that are connected end-to-end so as to form a "drill string." The bit is rotated by rotating the drill string at the surface or by actuation of downhole motors or turbines, or by both methods. With weight applied to the drill string, the rotating bit engages the earthen formation causing the bit to cut through the formation material by either abrasion, fracturing, or shearing action, or through a combination of all cutting methods, thereby forming a borehole along a predetermined path toward a target zone.

Many different types of drill bits have been developed and found useful in drilling such boreholes. Two predominate types of drill bits are roller cone bits and fixed cutter (or rotary drag) bits. Most fixed cutter bit designs include a plurality of blades angularly spaced about the bit face. The blades project radially outward from the bit body and form flow channels therebetween. In addition, cutting elements are typically grouped and mounted on several blades in radially extending rows. The configuration or layout of the cutting elements on the blades may vary widely, depending on a number of factors, such as the formation to be drilled.

The cutting elements disposed on the blades of a fixed cutter bit are typically formed of extremely hard materials. In a typical fixed cutter bit, each cutting element includes an elongate and generally cylindrical tungsten carbide substrate that is received and secured in a pocked formed in the surface of one of the blades. The cutting elements typically include a hard cutting layer of polycrystalline diamond ("PCD") or other superabrasive materials such as thermally stable diamond or polycrystalline cubic boron nitride. For convenience, as used herein, reference to "PDC bit" or "PDC cutters" refers to a fixed cutter bit or cutting element employing a hard cutting layer of polycrystalline diamond or other superabrasive materials.

Referring to FIGS. 1 and 2, a conventional fixed cutter or drag bit 10 adapted for drilling through formations of rock to form a borehole is shown. The bit 10 generally includes a bit body 12, a shank 13, and a threaded connection or pin 14 at a pin end 16 for connecting the bit 10 to a drill string (not shown) that is employed to rotate the bit in order to drill the borehole. The bit face 20 supports a cutting structure 15 and is formed on the end of the bit 10 that is opposite the pin end 16. The bit 10 further includes a central axis 11 about which the bit 10 rotates in the cutting direction represented by arrow 18.

A cutting structure 15 is provided on the face 20 of the bit 10. The cutting structure 15 includes a plurality of angularly spaced-apart primary blades 31, 32, 33, and secondary blades 34, 35, 36, each of which extends from the bit face 20. The primary blades 31, 32, 33 and the secondary blades 34, 35, 36 extend generally radially along the bit face 20 and then axially along a portion of the periphery of the bit 10. However, the secondary blades 34, 35, 36 extend radially along the bit face 20 from a position that is distal the bit axis 11 toward the periphery of the bit 10. Thus, as used herein, "secondary blade" may be used to refer to a blade that begins at some distance from the bit axis and extends generally radially along the bit face to the periphery of the bit. The primary blades 31, 32, 33 and the secondary blades 34, 35, 36 are separated by drilling fluid flow courses 19.

Referring still to FIGS. 1 and 2, each primary blade 31, 32, 33 includes blade tops 42 for mounting a plurality of cutting elements, and each secondary blade 34, 35, 36 includes blade tops 52 for mounting a plurality of cutting elements. In particular, cutting elements 40, each having a cutting face 44, are mounted in pockets formed in blade tops 42, 52 of each primary blade 31, 32, 33 and each secondary blade 34, 35, 36, respectively. Cutting elements 40 are arranged adjacent one another in a radially extending row proximal the leading edge of each primary blade 31, 32, 33 and each secondary blade 34, 35, 36. Each cutting face 44 has an outermost cutting tip **44*a* furthest from the blade tops 42, 52 to which the cutting elements 40** are mounted.

Referring now to FIG. 3, a profile of bit 10 is shown as it would appear with all blades (e.g., primary blades 31, 32, 33 and secondary blades 34, 35, 36) and cutting faces 44 of all cutting elements 40 rotated into a single rotated profile. In rotated profile view, blade tops 42, 52 of all blades 31-36 of the bit 10 form and define a combined or composite blade profile 39 that extends radially from the bit axis 11 to the outer radius 23 of the bit 10. Thus, as used herein, the phrase "composite blade profile" refers to the profile, extending from the bit axis to the outer radius of the bit, formed by the blade tops of all the blades of a bit rotated into a single rotated profile (i.e., in rotated profile view).

The conventional composite blade profile 39 (most clearly shown in the right half of bit 10 in FIG. 3) may generally be divided into three regions conventionally labeled cone region 24, shoulder region 25, and gage region 26. The cone region 24 includes the radially innermost region of the bit 10 and the composite blade profile 39 extending generally from the bit axis 11 to the shoulder region 25. As shown in FIG. 3, in most conventional fixed cutter bits, the cone region 24 is generally concave. Adjacent the cone region 24 is the shoulder (or the upturned curve) region 25. In most conventional fixed cutter bits, the shoulder region 25 is generally convex. Moving radially outward, adjacent the shoulder region 25 is the gage region 26 which extends parallel to the bit axis 11 at the outer radial periphery of the composite blade profile 39. Thus, the composite blade profile 39 of the conventional bit 10 includes one concave region, cone region 24, and one convex region, shoulder region 25.

The axially lowermost point of the convex shoulder region 25 and the composite blade profile 39 defines a blade profile nose 27. At the blade profile nose 27, the slope of a tangent line **27*a* to the convex shoulder region 25 and the composite blade profile 39 is zero. Thus, as used herein, the term "blade profile nose" refers to the point along a convex region of a composite blade profile of a bit in rotated profile view at which the slope of a tangent to the composite blade profile is zero. For most conventional fixed cutter bits (e.g., bit 10), the composite blade profile includes only one convex shoulder region (e.g., convex shoulder region 25), and only one blade profile nose (e.g., nose 27). As shown in FIGS. 1-3, the cutting elements 40 are arranged in rows along the blades 31-36 and are positioned along the bit face 20 in the regions previously described as cone region 24, shoulder region 25 and gage region 26 of the composite blade profile 39. In particular, the cutting elements 40 are mounted on the blades 31-36 in predetermined radially-spaced positions relative to the central axis 11 of the bit 10**.

Without regard to the type of bit, the cost of drilling a borehole is proportional to the length of time it takes to drill the borehole to the desired depth and location. The drilling time, in turn, is greatly affected by the number of times the drill bit is changed before reaching the targeted formation. This is the case because each time the bit is changed, the entire drill string, which may be miles long, must be retrieved from the borehole section by section. Once the drill string has been retrieved and the new bit installed, the bit must be lowered to the bottom of the borehole on the drill string, which again, must be constructed section by section. This process, known as a "trip" of the drill string, generally requires considerable time, effort, and expense. Accordingly, it is desirable to employ drill bits that will drill faster and longer and that are usable over a wider range of differing formation hardnesses.

The length of time that a drill bit may be employed before it is changed depends upon its rate of penetration ("ROP"), as well as its durability or ability to maintain a high or acceptable ROP. Additionally, a desirable characteristic of the bit is that it be "stable" and resist undesirable vibration, the most severe type or mode of which is "whirl," which is a term used to describe the phenomenon where a drill bit rotates at the bottom of the borehole about a rotational axis that is offset from the geometric center of the drill bit. Such whirling subjects the cutting elements on the bit to increased loading, which causes premature wearing or destruction of the cutting elements and a loss of ROP. Thus, preventing or reducing undesirable bit vibration and maintaining stability of PDC bits has long been a desirable goal, but one that has not always been achieved. Undesirable bit vibration typically may occur in any type of formation, but is most detrimental in harder formations.

In recent years, the PDC bit has become an industry standard for cutting formations of soft and medium hardnesses. However, as PDC bits are being developed for use in harder formations, bit stability is becoming an increasing challenge. As previously described, excessive undesirable bit vibration during drilling tends to dull the bit and/or may damage the bit to an extent that a premature trip of the drill string becomes necessary or desired.

There have been a number of alternative designs proposed for PDC cutting structures that were meant to provide a PDC bit capable of drilling through a variety of formation hardnesses at effective ROPs and with acceptable bit life or durability. Unfortunately, many of the bit designs aimed at minimizing vibration require that drilling be conducted with an increased weight-on-bit ("WOB") as compared to bits of earlier designs. For example, some bits have been designed with cutters mounted at less aggressive back rake angles such that they require increased WOB in order to penetrate the formation material to the desired extent. Drilling with an increased or heavy WOB is generally avoided if possible. Increasing the WOB is accomplished by adding additional heavy drill collars to the drill string. This additional weight increases the stress and strain on some or all drill string components, causes stabilizers to wear more and to work less efficiently, and increases the hydraulic drop in the drill string, requiring the use of higher capacity (and typically higher cost) pumps for circulating the drilling fluid. Compounding the problem still further, the increased WOB causes the bit to wear and become dull more quickly than would otherwise occur. In order to postpone tripping the drill string, it is common practice to add further WOB and to continue drilling with the partially worn and dull bit. The relationship between bit wear and WOB is not linear, but is an exponential one, such that upon exceeding a particular WOB for a given bit, a very small increase in WOB will cause a tremendous increase in bit wear. Thus, adding more WOB so as to drill with a partially worn bit further escalates the wear on the bit and other drill string components.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some embodiments, a cutting tool includes a tool body; a plurality of blades extending from the tool body; and a plurality of non-planar cutting elements disposed along each of the plurality of blades. The plurality of non-planar cutting elements form a cutting profile, in a rotated view of the plurality of non-planar cutting elements into a single plane, the cutting profile including a cone region, a nose region, a shoulder region, and a gage region. The plurality of non-planar cutting elements include a first shape in at least one of the cone region, nose region, shoulder region, and gage region, and a second, different shape in at least one other region.

In some embodiments, a cutting tool includes a tool body; a plurality of blades extending from the tool body; and a plurality of non-planar cutting elements disposed along each of the plurality of blades. The plurality of non-planar cutting elements form a cutting profile, in a rotated view of the plurality of non-planar cutting elements into a single plane, the cutting profile including a cone region, a nose region, a shoulder region, and a gage region. The plurality of non-planar cutting elements have an apex having first radius of curvature in at least one of the cone region, nose region, shoulder region, and gage region, and an apex having a second, different radius of curvature in at least one other region.

In some embodiments, a cutting tool includes a tool body; a plurality of blades extending from the tool body; and a plurality of non-planar cutting elements disposed along each of the plurality of blades. The plurality of non-planar cutting elements form a cutting profile, in a rotated view of the plurality of non-planar cutting elements into a single plane, the cutting profile including a cone region, a nose region, a shoulder region, and a gage region. The plurality of non-planar cutting elements have a first diameter in at least one of the cone region, nose region, shoulder region, and gage region, and a second, different diameter in at least one other region.

In some embodiments, a cutting tool includes a tool body; a plurality of blades extending from the tool body; and a plurality of non-planar cutting elements disposed along each of the plurality of blades. The plurality of non-planar cutting elements form a cutting profile, in a rotated view of the plurality of non-planar cutting elements into a single plane, the cutting profile including a cone region, a nose region, a shoulder region, and a gage region. The plurality of non-planar cutting elements have a first material property in at least one of the cone region, nose region, shoulder region, and gage region, and a second, distinct material property in at least one other region.

Other aspects and advantages of the claimed subject matter will be apparent from the following description and the appended claims.

BRIEF DESCRIPTION OF DRAWINGS

FIGS. 5-1 and 5-2 show cutting profiles according to example embodiments.

DETAILED DESCRIPTION

In aspects of the present disclosure, embodiments relate to fixed cutting drill bits or other downhole cutting tools containing cutting elements with non-planar cutting surfaces. In particular, embodiments disclosed herein relate to drill bits containing two or more non-planar cutting elements, the at least two cutting elements having different geometric or dimensional profiles and/or different material properties. Other embodiments disclosed herein relate to fixed cutter drill bits containing such cutting elements, including the placement of such cutting elements on a bit and variations on the cutting elements that may be used to optimize or improve drilling.

Figure 1:
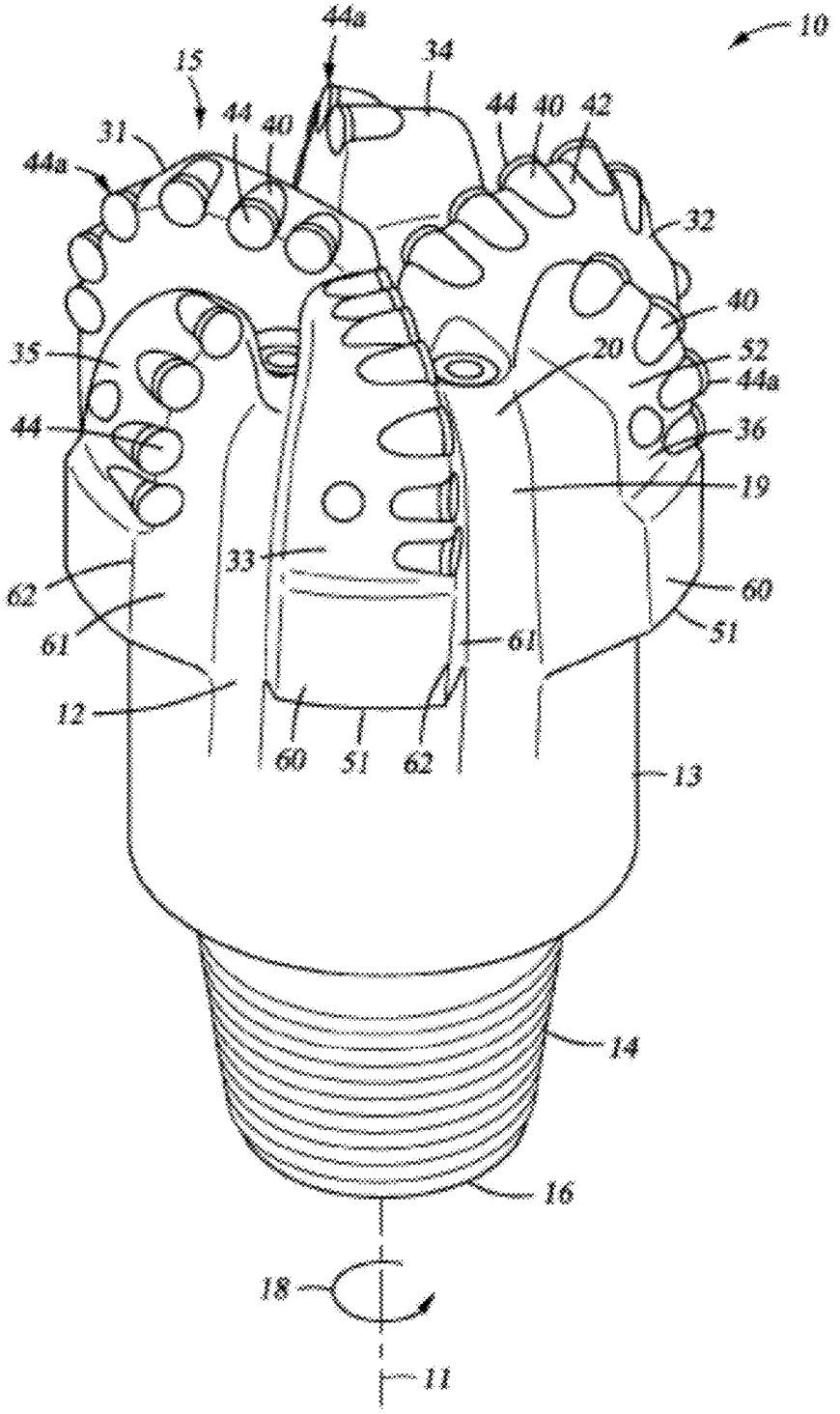
Fig. 1 (PRIOR ART)
FIG. 1 shows a conventional drill bit.
Figure 2:
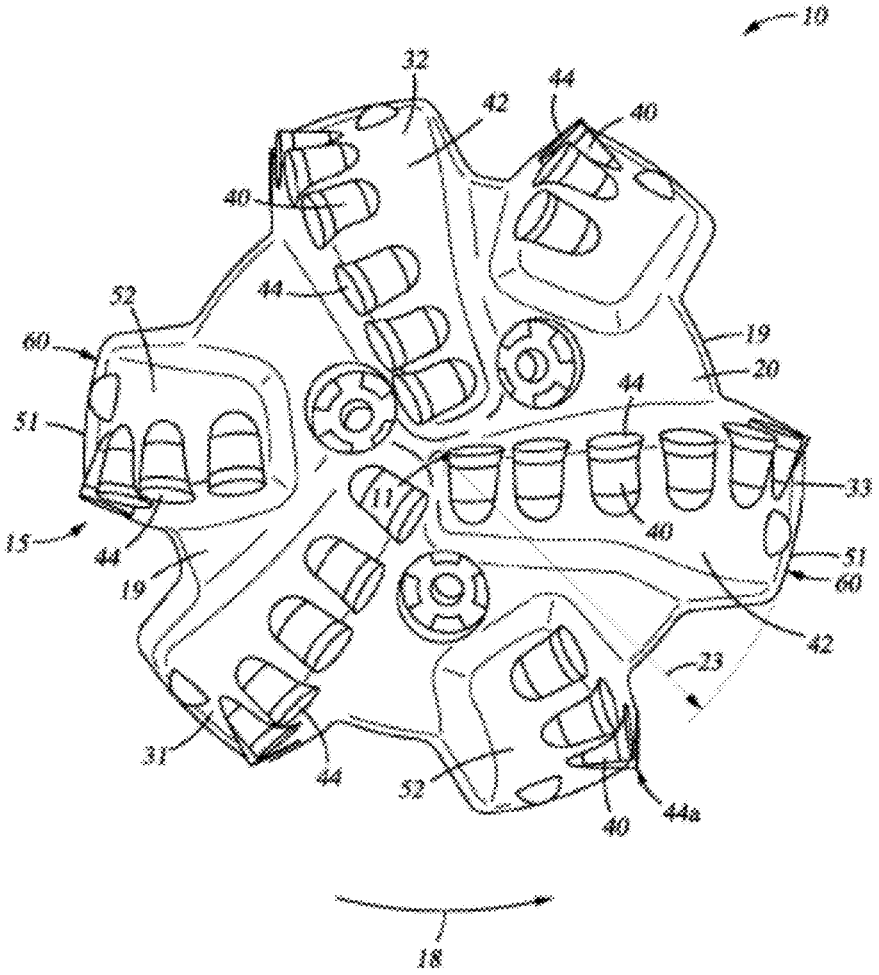
Fig. 2 (PRIOR ART)
FIG. 2 shows a top view of a conventional drill bit.
Figure 3:
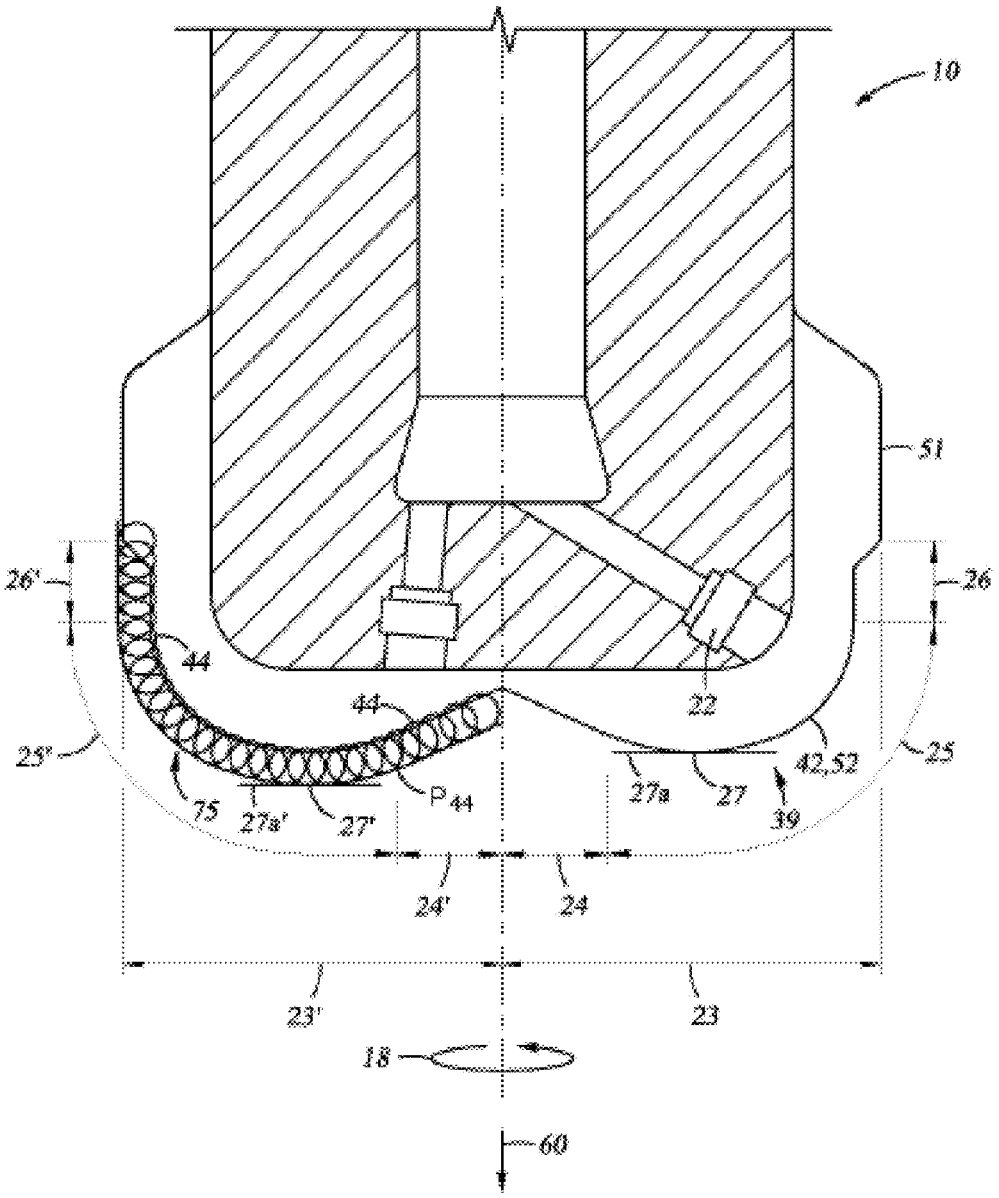
Fig. 3 (PRIOR ART)
FIG. 3 shows a cross-sectional view of a conventional drill bit.
Figure 4:
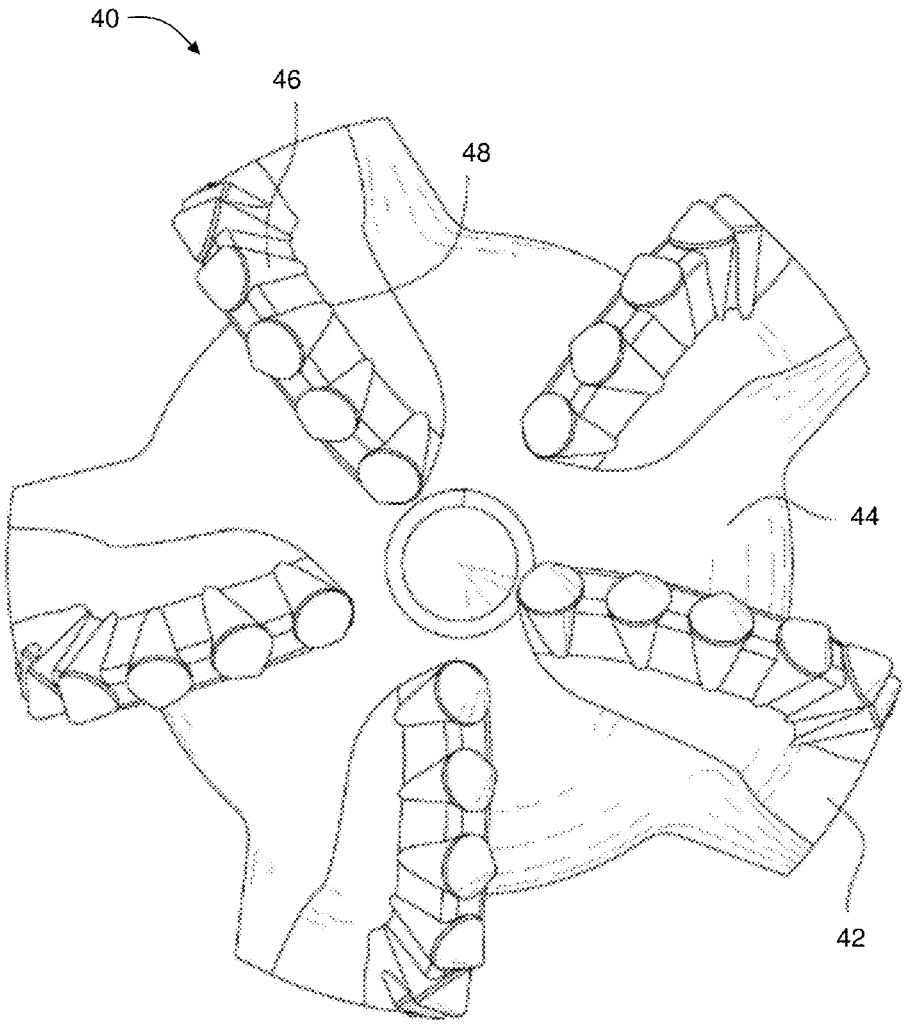
FIG. 4 shows a top view of a drill bit according to one embodiment.
Figures 1, 5:
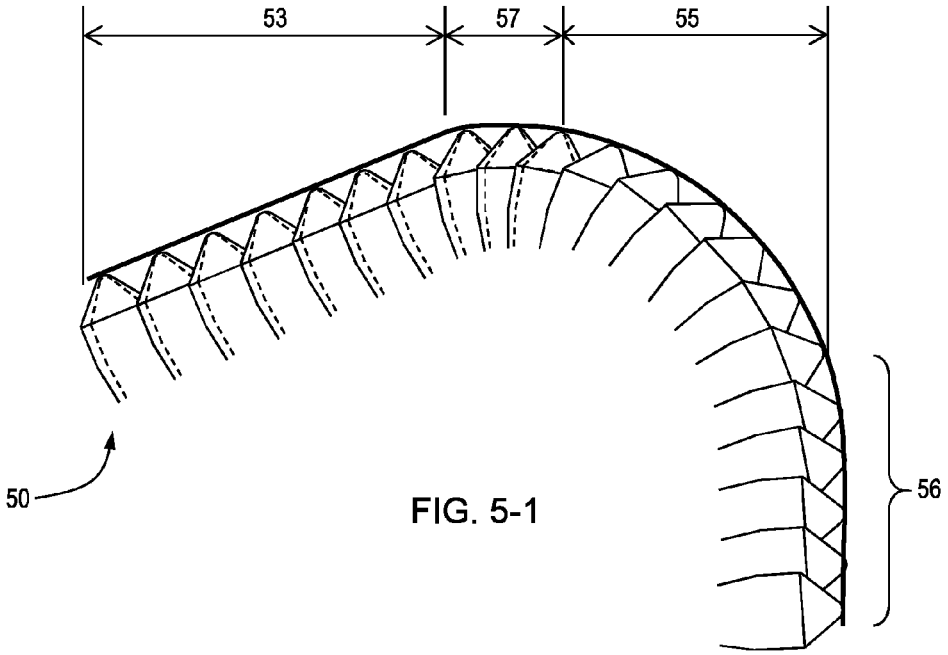
Figures 2, 5:
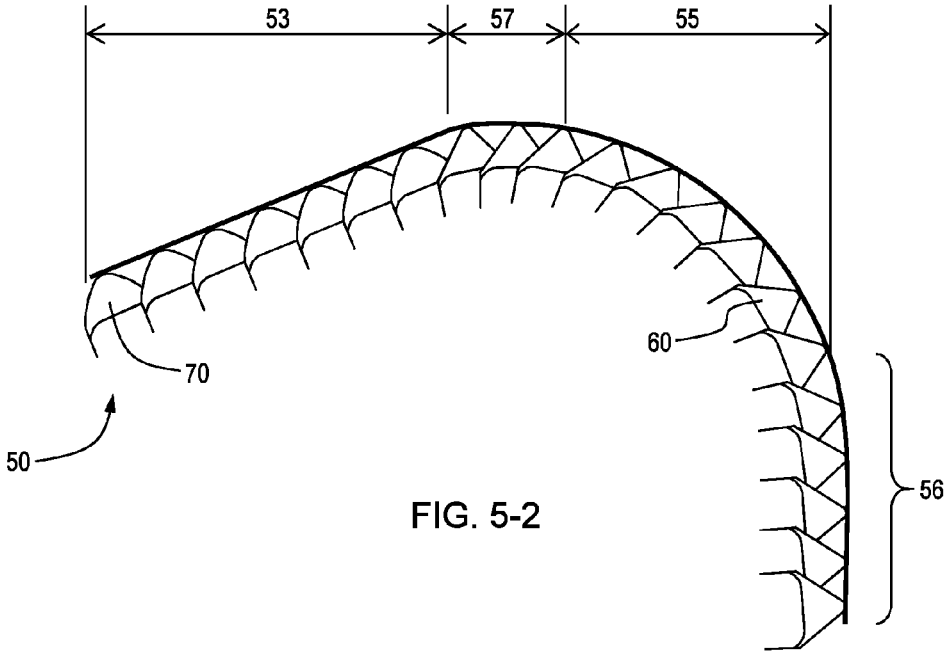
Figure 6:
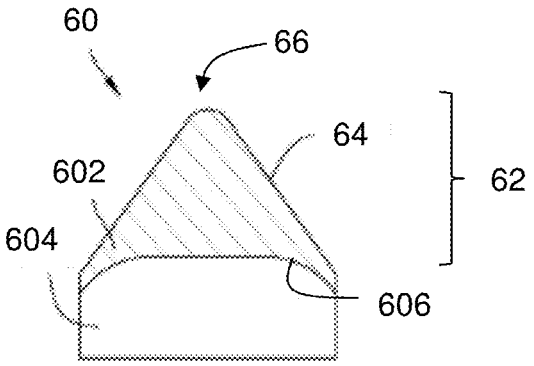
FIG. 6 shows a cross-sectional view of a conical cutting element.
Figure 7:
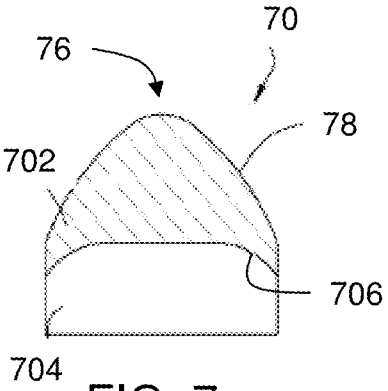
FIG. 7 shows a cross-sectional view of a pointed cutting element having a convex side surface.
Figure 8:
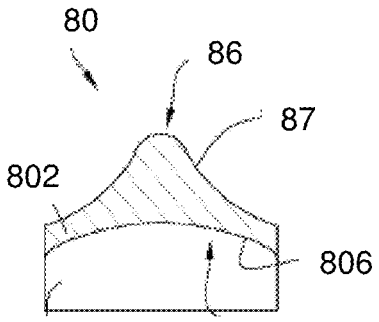
FIG. 8 shows a cross-sectional view of a pointed cutting element having a concave side surface.

In accordance with one or more embodiments of the present disclosure, different non-planar cutting elements may be used, and the geometry selected based on the location of the particular non-planar cutting element along the cutting profile, as defined, for example, with reference to FIG. 3. Referring now to FIG. 4, the top view of an embodiment of a drill bit is shown. As shown in FIG. 4, a drill bit 40 may include a plurality of blades 42 extending radially from a bit body 44. Non-planar cutting elements 46 are each within cutter pockets 48 on the plurality of blades 42. While only non-planar cutting elements are illustrated in FIG. 4, is it also within the scope of the present disclosure that one or more blade may include one or more planar or substantially planar cutting elements thereon. Referring now to FIGS. 5-1 and 5-2, a cutting profile (where all cutting elements on a bit are shown rotated into a single plane) is shown. Similar to the cutting profile defined above in FIG. 3, the cutting profiles 50 shown in FIGS. 5-1 and 5-2 include a cone region 53, a nose region 57, a shoulder region, 55, and gage region 56; however, in the embodiment shown in FIGS. 5-1 and 5-2, the cutting profiles are formed from non-planar cutting elements. Further, while the non-planar cutting elements shown in FIG. 5-1 are conical cutting elements, the present disclosure is not so limited. Rather, one or more, or all of the cutting elements forming a cutting profile of the present disclosure may include non-planar cutting elements other than conical cutting elements (see FIG. 5-2). For example, referring now to FIGS. 6-8, illustrations of the various non-planar cutting elements that may be used in embodiments of the present disclosure are shown.

For ease in distinguishing between the multiple types of cutting elements, the term "cutting elements" will generically refer to any type of cutting element, while "cutter" will refer those cutting elements with a planar cutting face, as described above in reference to FIGS. 1 and 2, and "non-planar cutting element" will refer to those cutting elements having a non-planar top surface, e.g., having an end terminating in an apex, which may include cutting elements having a conical cutting end (shown in FIG. 6) or a bullet cutting element (shown in FIG. 7), for example (both of which could also be called "pointed cutting elements"). As used herein, the term "conical cutting elements" refers to cutting elements having a generally conical cutting end 62 (including either right cones or oblique cones), i.e., a conical side wall 64 that terminates in a rounded apex 66, as shown in FIG. 6. Unlike geometric cones that terminate at a sharp point apex, the conical cutting elements of the present disclosure possess an apex having curvature between the side surfaces and the apex. Further, in one or more embodiments, a bullet cutting element 70 may be used. The term "bullet cutting element" refers to a cutting element having, instead of a generally conical side surface, a generally convex side surface 78 terminated in a rounded apex 76. In one or more embodiments, the apex 76 has a substantially smaller radius of curvature than the convex side surface 78. However, it is also intended that the non-planar cutting elements of the present disclosure may also include other shapes, including, for example, a concave side surface terminating in a rounded apex, shown in FIG. 8. In each of such embodiments, the non-planar cutting elements may have a smooth transition between the side surface and the rounded apex (i.e., the side surface or side wall tangentially joins the curvature of the apex), but in some embodiments, a non-smooth transition may be present (i.e., the tangent of the side surface intersects the tangent of the apex at a non-180 degree angle, such as for example ranging from about 120 to less than 180 degrees). Further, in one or more embodiments, the non-planar cutting elements may include any shape having a cutting end extending above a grip or base region, where the cutting end extends a height that is at least 0.25 times the diameter of the cutting element, or at least 0.3, 0.4, 0.5 or 0.6 times the diameter in one or more other embodiments.

Various embodiments of the present disclosure may use cutting elements of different shapes (such as those shown in FIGS. 6-8, e.g., non-planar cutting elements or pointed cutting elements) along the cutting profile. For example, in one embodiment, the cone region may include one or more bullet cutting elements 70, while the nose, shoulder, and gage region may include one or more non-planar cutting elements (or pointed cutting elements) that are not bullet cutting elements, such as a conical cutting element 60 or a concave cutting element 80. In particular embodiments (see FIG. 5-2), the cone region 53 may include one or more (or all) bullet cutting elements 70 and the nose, shoulder, and gage regions 55-57 may include one or more (or all) conical cutting elements 60. Such embodiments may be selected, for example, when greater impact protection in the cone region 53 is desired.

In another embodiment, the cone and nose regions may include one or more bullet cutting elements 70, while the shoulder and gage region may include one or more non-planar cutting elements that are not bullet cutting elements, such as a conical cutting element 60 or a concave cutting element 80. In particular embodiments, the cone and nose regions may include one or more (or all) bullet cutting elements 70 and the shoulder and gage regions may include one or more (or all) conical cutting elements 60. Such embodiments may be selected, for example, when greater impact protection in the cone and nose region is desired.

In another embodiment, the cone, nose, and shoulder regions may include one or more bullet cutting elements 70, while the gage region may include one or more non-planar cutting elements that are not bullet cutting elements, such as a conical cutting element 60 or a concave cutting element 80. In particular embodiments, the cone, nose, and shoulder regions may include one or more (or all) bullet cutting elements 70 and the gage region may include one or more (or all) conical cutting elements 60. Such embodiments may be selected, for example, for high impact applications.

In one embodiment, the cone region may include one or more conical cutting elements 60, while the nose, shoulder, and gage region may include one or more non-planar cutting elements that are not conical cutting elements, such as a bullet cutting element 70 or a concave cutting element 80. In particular embodiments, the cone region may include one or more (or all) conical cutting elements 60 and the nose, shoulder, and gage regions may include one or more (or all) bullet cutting elements 70. Such embodiments may be selected, for example, when greater impact protection in the nose, shoulder, and gage region is desired.

In another embodiment, the cone and nose regions may include one or more conical cutting elements 60, while the shoulder and gage region may include one or more non-planar cutting elements that are not conical cutting elements, such as a bullet cutting element 70 or a concave cutting element 80. In particular embodiments, the cone and nose regions may include one or more (or all) conical cutting elements 60 and the shoulder and gage regions may include one or more (or all) bullet cutting elements 70. Such embodiments may be selected, for example, when greater impact protection in the shoulder and gage region is desired.

In another embodiment, the cone, nose, and shoulder regions may include one or more conical cutting elements 60, while the gage region may include one or more non-planar cutting elements that are not conical cutting elements, such as a bullet cutting element 70 or a concave cutting element 80. In particular embodiments, the cone, nose, and shoulder regions may include one or more (or all) conical cutting elements 60 and the gage region may include one or more (or all) bullet cutting elements 70. Such embodiments may be selected, for example, when greater impact protection in the gage region is desired.

Further, in another embodiment, the cone and shoulder region may have the same selected shape, with a different shape in the nose region. For example, in one embodiment, the cone and shoulder regions may include one or more conical cutting elements 60, while the nose region may include one or more non-planar cutting elements that are not conical cutting elements, such as a bullet cutting element 70 or a concave cutting element 80. In particular embodiments, the cone and shoulder region may include one or more (or all) conical cutting elements 60 and the nose region may include one or more (or all) bullet cutting elements 70. It is also within the scope of the present disclosure that the gage region may also have one or more (or all) bullet cutting elements 70.

In another embodiment, the cone and shoulder regions may include one or more bullet cutting elements 70, while the nose region may include one or more non-planar cutting elements that are not conical cutting elements, such as a conical cutting element 60 or a concave cutting element 80. In particular embodiments, the cone and shoulder region may include one or more (or all) bullet cutting elements 70 and the nose region may include one or more (or all) conical cutting elements 60. It is also within the scope of the present disclosure that the gage region may also have one or more (or all) conical cutting elements 60.

As mentioned above, the apex of the non-planar cutting element may have curvature, including a radius of curvature. In one or more embodiments, the radius of curvature may range from about 0.050 to 0.125. One or more other embodiments may use a radius of curvature of with a lower limit of any of 0.050, 0.060, 0.075, 0.085, or 0.100 and an upper limit of any of 0.075, 0.085, 0.095, 0.100, 0.110, or 0.0125, where any lower limit can be used with any upper limit. In some embodiments, the curvature may have a variable radius of curvature, a portion of a parabola, a portion of a hyperbola, a portion of a catenary, or a parametric spline. Further, in one or more embodiments, the different apex curvatures may be used in (the same geometry-type or different geometry type) cutting elements along a cutting profile. This may include, for example, the various embodiments described above, as well as embodiments including all conical cutting elements, or all bullet cutting elements, etc., along a cutting profile. Specifically a "blunt" cutting element may include any type of non-planar cutting element having a larger radius of curvature as compared to another, "sharp" non-planar cutting element on the same bit. Thus, the terms blunt and sharp are relative to one another, and the radius of curvatures of each may selected from any point along the radius range discussed above.

For example, in one embodiment, the cone region may include one or more (or all) blunt cutting elements and the nose, shoulder, and gage regions may include one or more (or all) sharp cutting elements. Such embodiment may be selected, for example, when greater impact protection in the cone region is desired.

In another embodiment, the cone and nose regions may include one or more (or all) blunt cutting elements and the shoulder and gage regions may include one or more (or all) sharp cutting elements. Such embodiment may be selected, for example, when greater impact protection in the cone and nose region is desired.

In another embodiment, the cone, nose, and shoulder regions may include one or more (or all) blunt cutting elements and the gage region may include one or more (or all) sharp cutting elements. Such embodiment may be selected, for example, when greater impact protection in the cone, nose, and shoulder region is desired.

In one embodiment, the cone region may include one or more (or all) sharp cutting elements and the nose, shoulder, and gage regions may include one or more (or all) blunt cutting elements. Such embodiment may be selected, for example, when greater impact protection in the nose, shoulder, and gage region is desired.

In another embodiment, the cone and nose regions may include one or more (or all) sharp cutting elements and the shoulder and gage regions may include one or more (or all) blunt cutting elements. Such embodiment may be selected, for example, when greater impact protection in the shoulder and gage region is desired.

In another embodiment, the cone, nose, and shoulder regions may include one or more (or all) sharp cutting elements and the gage region may include one or more (or all) blunt cutting elements. Such embodiment may be selected, for example, when greater impact protection in the gage region is desired.

Further, in another embodiment, the cone and shoulder region may have the same selected bluntness or sharpness, with a different radius in the nose region. For example, in one embodiment, the cone and shoulder regions may include one or more (or all) sharp cutting elements and the nose region may include one or more (or all) blunt cutting elements. It is also within the scope of the present disclosure that the gage region may also have one or more (or all) blunt cutting elements 70.

In another embodiment, the cone and shoulder region may include one or more (or all) blunt cutting elements and the nose region may include one or more (or all) sharp cutting elements. It is also within the scope of the present disclosure that the gage region may also have one or more (or all) sharp cutting elements.

Further, in one or more other embodiments, the diameter of the non-planar cutting element may be varied along the cutting profile. For example, the diameter of the non-planar cutting elements may generally range from 9 mm to 20 mm, such as 9 mm, 11 mm, 13 mm, 16 mm, 19 mm, and 22 mm. Selection of different sizes along the cutter profile may allow variation in the number of cutting elements at a particular region of the blades. Specifically a "large" cutting element may include any type of non-planar cutting element having a larger diameter as compared to another, "small" non-planar cutting element on the same bit. Thus, the terms large and small are relative to one another, and the diameter of each may selected from any point along the diameter range discussed above. Further, it is also within the scope of the present disclosure that the same diameter cutting element may be used in any of the above described embodiments, and the desired size may be selected, for example, based on the type of formation to be drilled. For example, in softer formations, it may be desirable to use a larger cutting element, whereas in a harder formation, it may be desirable to use a smaller cutting element.

For example, in one embodiment, the cone region may include one or more (or all) small cutting elements and the nose, shoulder, and gage regions may include one or more (or all) large cutting elements. Such embodiments may be selected, for example, when greater diamond density and impact load distribution in the cone region is desired.

In another embodiment, the cone and nose regions may include one or more (or all) small cutting elements and the shoulder and gage regions may include one or more (or all) large cutting elements (see cutting elements schematically represented by dashed lines in cone and nose regions 53, 57 of FIG. 5-1). Such embodiments may be selected, for example, when greater diamond density and impact load distribution in the cone and nose region is desired.

In another embodiment, the cone, nose, and shoulder regions may include one or more (or all) small cutting elements and the gage region may include one or more (or all) large cutting elements. Such embodiments may be selected, for example, when greater diamond density and impact load distribution in the cone, nose, and shoulder region is desired.

In one embodiment, the cone region may include one or more (or all) large cutting elements and the nose, shoulder, and gage regions may include one or more (or all) small cutting elements. Such embodiments may be selected, for example, when greater impact protection in the nose, shoulder, and gage region is desired.

In another embodiment, the cone and nose regions may include one or more (or all) large cutting elements and the shoulder and gage regions may include one or more (or all) small cutting elements. Such embodiments may be selected, for example, when greater diamond density and impact load distribution in the shoulder and gage region is desired.

In another embodiment, the cone, nose, and shoulder regions may include one or more (or all) large cutting elements and the gage region may include one or more (or all) small cutting elements. Such embodiments may be selected, for example, when greater diamond density and impact load distribution in the gage region is desired.

Further, in another embodiment, the cone and shoulder region may have the same selected diameter, with a different size in the nose region. For example, in one embodiment, the cone and shoulder regions may include one or more (or all) large cutting elements and the nose region may include one or more (or all) small cutting elements. It is also within the scope of the present disclosure that the gage region may also have one or more (or all) small cutting elements.

In another embodiment, the cone and shoulder region may include one or more (or all) small cutting elements and the nose region may include one or more (or all) large cutting elements. It is also within the scope of the present disclosure that the gage region may also have one or more (or all) large cutting elements.

Further, it is also specifically within the scope of the present disclosure that various combinations of the different shapes, radii, and diameters may be used together along a cutting profile. For example, in one or more particular embodiments, the cutting elements may include both the different cutting end shapes as well as different diameters along the cutting profile. That is, a cutting element in the cone region may have a first shape and a first diameter, a cutting element in the nose region may have a second shape and the first (or a second) diameter, a cutting element in the shoulder region may have the second shape and the first (or a second) diameter, and a cutting element in a gage may have the second shape and the second diameter. Additionally, a cutting element in the cone region may have a first shape and a first diameter, a cutting element in the nose region may have a first shape and the first (or a second) diameter, a cutting element in the shoulder region may have the second shape and the first (or the second) diameter, and a cutting element in a gage may have the second shape and the second diameter. Finally, a cutting element in the cone region may have a first shape and first diameter, a cutting element in the nose region may have the first shape and the first (or a second) diameter, a cutting element in the shoulder region may have the first shape and the first (or the second) diameter, and a cutting element in a gage may have the second shape and the second diameter. Other combinations may also be envisioned in view of the above disclosure.

Further, as mentioned above, it is also within the scope of the present disclosure that one or more planar cutting elements, i.e., shear cutters, may be used at any location along the cutting profile. Thus, variations on the above embodiments also exist in which one or more of the regions may include one or more (or all) shear cutters. For example, in one embodiment, it is envisioned the shear cutters may particularly be used, for example, along the gage region. However, other embodiments replacing cutting elements along other regions may also be envisioned.

Referring back to FIGS. 6-8, variations of non-planar cutting elements that may be in any of the embodiments disclosed herein are shown. The non-planar cutting elements provided on a drill bit or reamer (or other cutting tool of the present disclosure) possess a diamond layer 602, 702, 802 on a substrate 604, 704, 804 (such as a cemented tungsten carbide substrate), where the diamond layer 602, 702, 802 forms the non-planar diamond working surface. Non-planar cutting elements may be formed in a process similar to that used in forming diamond enhanced inserts (used in roller cone bits) or may brazing of components together. The interface 606, 706, 806 between diamond layer 602, 702, 802 and substrate 604, 704, 804 may be non-planar or non-uniform, for example, to aid in reducing incidents of delamination of the diamond layer 602, 702, 802 from substrate 604, 704, 804 when in operation and to improve the strength and impact resistance of the element. One skilled in the art would appreciate that the interface may include one or more convex or concave portions, as known in the art of non-planar interfaces. Additionally, one skilled in the art would appreciate that use of some non-planar interfaces may allow for greater thickness in the diamond layer in the tip region of the layer. Further, it may be desirable to create the interface geometry such that the diamond layer is thickest at a zone that encompasses a contact zone between the diamond enhanced element and the formation (e.g., a primary contact zone or a critical zone). Additional shapes and interfaces that may be used for the diamond enhanced elements of the present disclosure include those described in U.S. Patent Publication No. 2008/0035380, which is herein incorporated by reference in its entirety. In one or more embodiments, the diamond layer 602, 702, 802 may have a thickness of 0.100 to 0.500 inches from the apex to the central region of the substrate, and in or more particular embodiments, such thickness may range from 0.125 to 0.275 inches. The diamond layer 602, 702, 802 and the cemented metal carbide substrate 604, 704, 804 may have a total thickness of 0.200 to 0.700 inches from the apex to a base of the cemented metal carbide substrate. However, other sizes and thicknesses may also be used.

Further, the diamond layer 602, 702, 802 may be formed from any polycrystalline superabrasive material, including, for example, polycrystalline diamond, polycrystalline cubic boron nitride, thermally stable polycrystalline diamond (formed either by treatment of polycrystalline diamond formed from a metal such as cobalt or polycrystalline diamond formed with a metal having a lower coefficient of thermal expansion than cobalt). Further, in one or more embodiments, the diamond grade (i.e., diamond powder composition including grain size and/or metal content) may be varied within a diamond layer 602, 702, 802. For example, in one or more embodiments, the region of diamond layer 602, 702, 802 adjacent the substrate 604, 704, 804 may differ in material properties (and diamond grade) as compared the region of diamond layer 602, 702, 802 at the apex 66, 76, 86 of the cutting element 60, 70, 80. Such variation may be formed by a plurality of step-wise layers or by a gradual transition.

Further, one or more aspects of the present disclosure also relate to the use of non-planar cutting elements being formed of different diamond grades, as compared to one another along the cutting profile. For example, in one or more embodiments, it may be desirable to have a more impact resistant diamond grade forming the diamond layer of non-planar cutting elements in the cone region, and more abrasion resistant diamond grade forming the diamond layer of non-planar cutting elements in the gage region. Further, in one or more embodiments, the nose and shoulder regions may also be more impact resistant than the gage region. In one or more other embodiments, the nose may be formed from a more impact resistant diamond grade, and the shoulder may be formed from a more abrasion resistant diamond grade. Further, in yet other embodiments, both the nose and the shoulder may also be formed from more abrasion resistant diamond grades, as compared to the cone. Such differences in material properties may result from a change in the metal/diamond content (i.e., diamond density) in the diamond layer and/or a change in the diamond grain size. Generally, in one or more embodiments, the overall trend in diamond density (from the center of the bit to the outer radius) used in forming the diamond layers is a general increase in diamond density from the cone to the gage. The desired properties may also be achieved by varying the diamond grain size, where the overall trend in grain size (from the center of the bit to the outer radius) used in forming the diamond layers may be a general reduction in diamond grain size from the cone to the gage.

Similarly, diamond grain size differences may also result in a difference in wear resistance, with a reduction in grain size generally resulting in an increase in wear resistance. Differences in wear resistance may be achieved (in addition to varying the diamond grade as mentioned above) by using different sintering conditions, by removing metals such as cobalt from the interstitial spaces in the diamond layer, by using different compositions to avoid the use of cobalt in forming the diamond layer, or by any other suitable method.

In one or more embodiments, it may also be desirable to use an overall trend in diamond wear resistance (from the center of the bit to the outer radius). For example, in one or more embodiments, it may be desirable to have a more wear resistant diamond layer of non-planar cutting elements in the gage region, and less wear resistant diamond layer of non-planar cutting elements in the cone region. Further, in one or more embodiments, the nose and shoulder regions may also be more wear resistant than the cone region. In one or more other embodiments, the shoulder may be formed from a more wear resistant diamond grade, and the nose may be formed from a less wear resistant diamond grade. Further, in yet other embodiments, both the nose and the shoulder may also be formed from less wear resistant diamond grades, as compared to the gage.

Thus, in one or more embodiments, the more wear resistant diamond layers may be formed from ultrahard materials (such as diamond) having varying levels of thermal stability. Conventional polycrystalline diamond is stable at temperatures of up to 700-750° C. in air, above which observed increases in temperature may result in permanent damage to and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Such ultrahard materials may include a conventional polycrystalline diamond table (a table of interconnected diamond particles having interstitial spaces therebetween in which a metal component (such as a metal catalyst) may reside, a thermally stable diamond layer (i.e., having a thermal stability greater than that of conventional polycrystalline diamond, 750° C.) formed, for example, by removing substantially all metal from the interstitial spaces between interconnected diamond particles or from a diamond/silicon carbide composite, or other ultrahard material such as a cubic boron nitride.

As known in the art, thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, typically hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

In some embodiments, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. Polycrystalline diamond compact cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer, such as by increasing the pressure to above 50 kbar with a temperature of above 1350° C.

Figure 9:
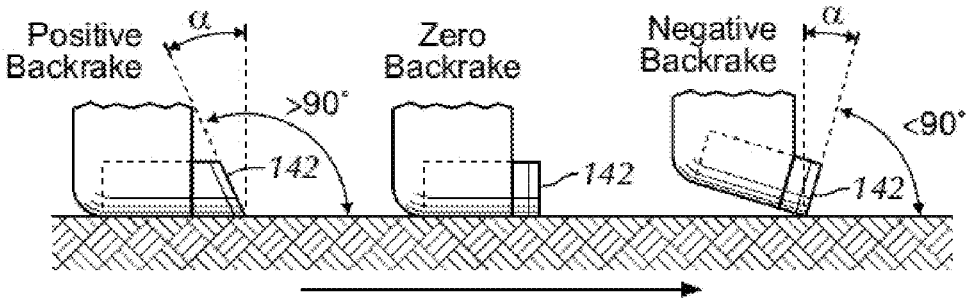
FIG. 9 shows cutters according to one or more embodiments.

The cutting elements of the present disclosure may be oriented at any back rake or side rake. Generally, when positioning cutting elements (specifically cutters) on a blade of a bit or reamer, the cutters may be inserted into cutter pockets (or holes in the case of conical cutting elements) to change the angle at which the cutter strikes the formation. Specifically, the back rake (i.e., a vertical orientation) and the side rake (i.e., a lateral orientation) of a cutter may be adjusted. Generally, back rake is defined as the angle $\alpha$ formed between the cutting face of the cutter 142 and a line that is normal to the formation material being cut. As shown in FIG. 9, with a conventional cutter 142 having zero backrake, the cutting face is substantially perpendicular or normal to the formation material. A cutter 142 having negative backrake angle $\alpha$ has a cutting face that engages the formation material at an angle that is less than 90° as measured from the formation material. Similarly, a cutter 142 having a positive backrake angle $\alpha$ has a cutting face that engages the formation material at an angle that is greater than 90° when measured from the formation material. Side rake is defined as the angle between the cutting face and the radial plane of the bit (x-z plane). When viewed along the z-axis, a negative side rake results from counterclockwise rotation of the cutter, and a positive side rake, from clockwise rotation. In a particular embodiment, the back rake of the conventional cutters may range from −5 to −45, and the side rake from 0-30.

Figure 10:
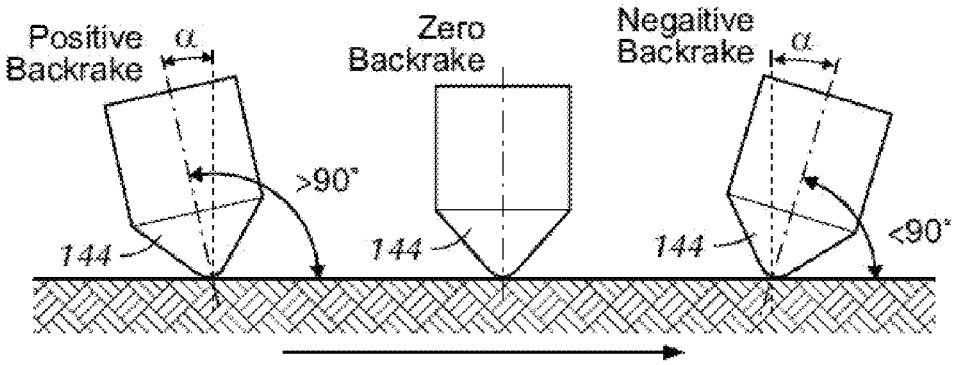
FIG. 10 shows conical cutting elements according to one or more embodiments.

However, pointed cutting elements do not have a planar cutting face and thus the orientation of pointed cutting elements may be defined differently. When considering the orientation of non-planar cutting elements, in addition to the vertical or lateral orientation of the cutting element body, the pointed geometry of the cutting end also affects how and the angle at which the pointed cutting element strikes the formation. Specifically, in addition to the backrake affecting the aggressiveness of the non-planar cutting element-formation interaction, the cutting end geometry (specifically, the apex angle and radius of curvature) greatly affect the aggressiveness that a pointed cutting element attacks the formation. In the context of a pointed cutting element, as shown in FIG. 10, backrake is defined as the angle $\alpha$ formed between the axis of the pointed cutting element 144 (specifically, the axis of the pointed cutting end) and a line that is normal to the formation material being cut. As shown in FIG. 10, with a pointed cutting element 144 having zero backrake, the axis of the pointed cutting element 144 is substantially perpendicular or normal to the formation material. A pointed cutting element 144 having negative backrake angle $\alpha$ has an axis that engages the formation material at an angle that is less than 90° as measured from the formation material. Similarly, a pointed cutting element 144 having a positive backrake angle $\alpha$ has an axis that engages the formation material at an angle that is greater than 90° when measured from the formation material. In some embodiments, the backrake angle of the pointed cutting elements may be zero, or in some embodiments may be negative. In some embodiments, the backrake of the pointed cutting elements may range from −10 to 10, from zero to 10, and/or from −5 to 5.

Figure 11:
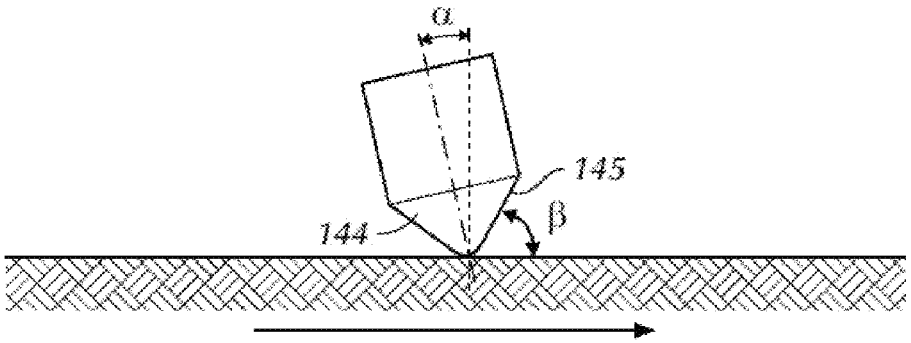
FIG. 11 shows a conical cutting element according to one or more embodiments.

In addition to the orientation of the axis with respect to the formation, the aggressiveness of the pointed cutting elements may also be dependent on the apex angle or specifically, the angle between the formation and the leading portion of the pointed cutting element. Because of the cutting end shape of the pointed cutting elements, there does not exist a leading edge; however, the leading line of a pointed cutting surface may be determined to be the first most points of the pointed cutting element at each axial point along the pointed cutting end surface as the bit rotates. Said in another way, a cross-section may be taken of a pointed cutting element along a plane in the direction of the rotation of the bit, as shown in FIG. 11. The leading line 145 of the pointed cutting element 144 in such plane may be considered in relation to the formation. The strike angle of a pointed cutting element 144 is defined to be the angle $\alpha$ formed between the leading line 145 of the pointed cutting element 144 and the formation being cut.

Figure 12:
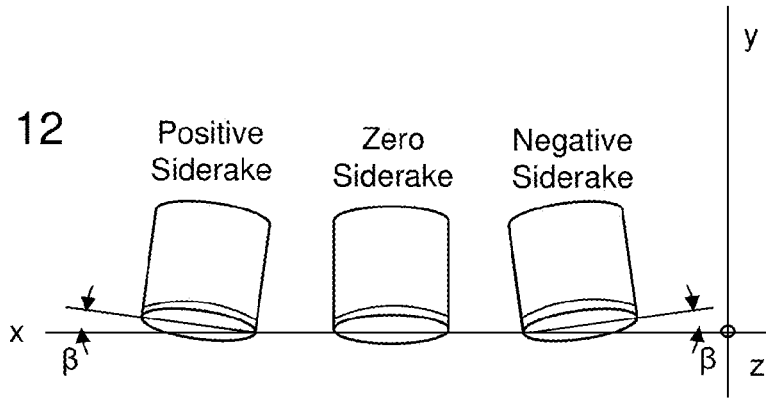
FIG. 12 shows cutters according to one or more embodiments.

Conventionally for PDC cutters, side rake is defined as the angle between the cutting face and the radial plane of the bit (x-z plane), as illustrated in FIG. 12. When viewed along the z-axis, a negative side rake angle $\beta$ results from counter-clockwise rotation of the cutter, and a positive side rake angle $\beta$, from clockwise rotation. In some embodiments, the side rake of cutters may range from −30 to 30 or from 0 to 30.

Figure 13:
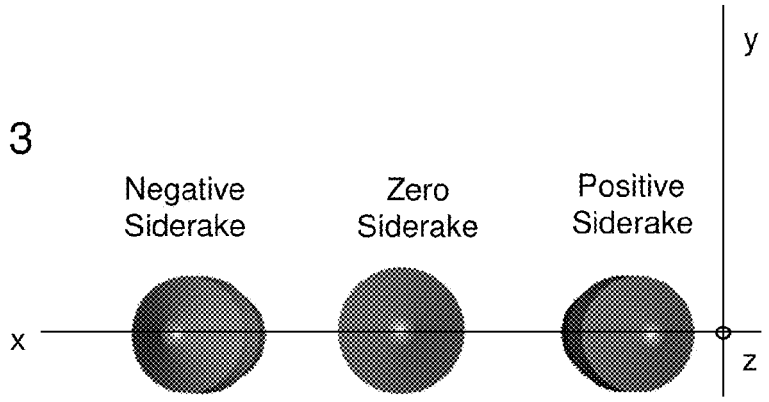
FIG. 13 shows top views of conical cutting elements according to one or more embodiments.
Figure 14:
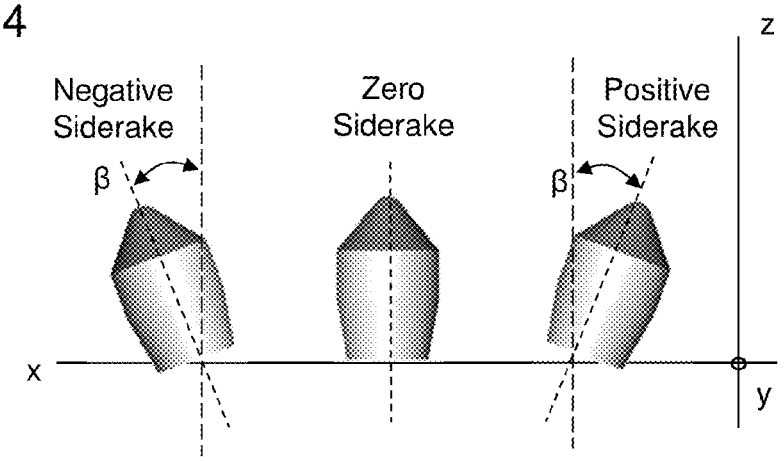
FIG. 14 shows side views of conical cutting elements according to one or more embodiments.

However, pointed cutting elements do not have a cutting face and thus the orientation of pointed cutting elements may be defined differently. In the context of a pointed cutting element, as shown in FIGS. 13 and 14, side rake is defined as the angle $\beta$ formed between the axis of the pointed cutting element (specifically, the axis of the conical cutting end) and a line parallel to the bit centerline, i.e., z-axis. As shown in FIGS. 13 and 14B, with a pointed cutting element having zero side rake, the axis of the pointed cutting element is substantially parallel to the bit centerline. A pointed cutting element having negative side rake angle $\beta$ has an axis that is pointed away from the direction of the bit centerline. Conversely, a pointed cutting element having a positive side rake angle $\beta$ has an axis that points towards the direction of the bit centerline. The side rake of the pointed cutting elements may range from about −30 to 30 in various embodiments and from −10 to 10 in other embodiments. Further, while not necessarily specifically mentioned in the following paragraphs, the side rake angles of the pointed cutting elements in the following embodiments may be selected from these ranges.

Figure 15:
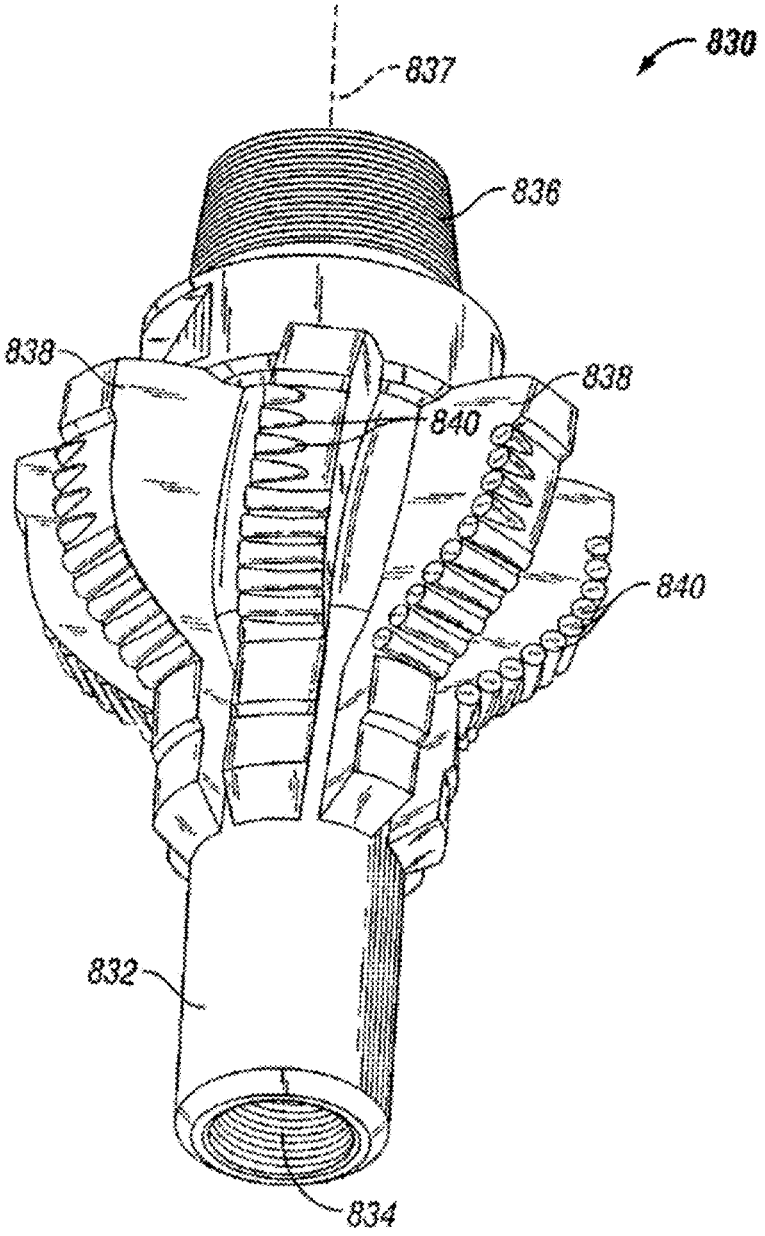
FIG. 15 shows a reamer according to one or more embodiments.

As described throughout the present disclosure, the cutting elements and cutting structure combinations may be used on either a fixed cutter drill bit or hole opener. FIG. 15 shows a general configuration of a hole opener 830 that may include one or more non-planar cutting elements of the present disclosure. The hole opener 830 includes a tool body 832 and a plurality of blades 838 disposed at selected azimuthal locations about a circumference thereof. The hole opener 830 generally includes connections 834, 836 (e.g., threaded connections) so that the hole opener 830 may be coupled to adjacent drilling tools that include, for example, a drillstring and/or bottom hole assembly (BHA) (not shown). The tool body 832 generally includes a bore therethrough so that drilling fluid may flow through the hole opener 830 as it is pumped from the surface (e.g., from surface mud pumps (not shown)) to a bottom of the wellbore (not shown).

The blades 838 shown in FIG. 15 are spiral blades and are generally positioned at substantially equal angular intervals about the perimeter of the tool body so that the hole opener 830. This arrangement is not a limitation on the scope of the invention, but rather is used merely to illustrative purposes. Those having ordinary skill in the art will recognize that any downhole cutting tool may be used. While FIG. 15 does not detail the location of the non-planar cutting elements, their placement on the tool may be according to one or more of the variations described above.

Although only a few example embodiments have been described in detail above, those skilled in the art will readily appreciate that many modifications are possible in the example embodiments without materially departing from this disclosure. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A cutting tool, comprising:

a tool body;

a plurality of blades extending from the tool body; and a first plurality of non-planar cutting elements and a second plurality of non-planar cutting elements on each of the plurality of blades, the first and second pluralities of non-planar cutting elements forming a cutting profile, in a rotated view of the first and pluralities of non-planar cutting elements into a single plane, the cutting profile including a cone region, a nose region, a shoulder region, and a gage region, the first plurality of non-planar cutting elements having a first shape and the second plurality of non-planar cutting elements having a second shape, the cone region including at least the first plurality of cutting elements but not the second plurality of cutting elements, neither the shoulder region nor the gage region including the first plurality of cutting elements, and at least one of the nose region, the shoulder region, and the gage region including the second plurality of cutting elements.

2. The cutting tool of claim 1, wherein the first plurality of non-planar cutting elements includes a bullet cutting element.

3. The cutting tool of claim 1, wherein the first plurality of non-planar cutting elements includes a conical cutting element.

4. The cutting tool of claim 1, wherein the first plurality of non-planar cutting elements and the second plurality of cutting elements cause the shoulder region to have greater impact protection than the cone and nose regions.

5. The cutting tool of claim 4, wherein each cutting element in the cone region includes the first plurality of non-planar cutting elements.

6. The cutting tool of claim 4, wherein each cutting element in the other three regions includes the second plurality of non-planar cutting elements.

7. The cutting tool of claim 1, wherein the first plurality of non-planar cutting elements are in the cone region and the nose region and the second plurality of non-planar cutting elements are in only the other two regions.

8. The cutting tool of claim 1, wherein at least one of the first or second plurality of non-planar cutting elements is blunt and at least one other of the first or second plurality of non-planar cutting elements is sharp.

9. The cutting tool of claim 1, wherein at least one of the first or second plurality of non-planar cutting elements has a first diameter and at least one other of the first or second plurality of non-planar cutting elements has a second, different diameter.

10. A cutting tool, comprising:

a tool body;

a plurality of blades extending from the tool body; and a first plurality of non-planar cutting elements and a second plurality of non-planar cutting elements on each of the plurality of blades, the first and second plurality of non-planar cutting elements forming a cutting profile, in a rotated view of the first and second plurality of non-planar cutting elements into a single plane, the cutting profile including a cone region, a nose region, a shoulder region, and a gage region, the first plurality of non-planar cutting elements having an apex with a first radius of curvature, and the second plurality of non-planar cutting elements having an apex with a second, different radius of curvature, at least the cone region, but not the shoulder region or the gage region, including the first plurality of non-planar cutting elements, and at least one of the nose region, shoulder region, and the gage region, but not the cone region, including the second plurality of non-planar cutting elements.

11. The cutting tool of claim 10, wherein the first plurality of non-planar cutting elements are only in the cone region and the second plurality of non-planar cutting elements are only in the nose region, the shoulder region, and the gage region.

12. The cutting tool of claim 10, wherein the first plurality of non-planar cutting elements are only in the cone region and the nose region, and the second plurality of non-planar cutting elements are only in the other shoulder region and the gage region.

13. The cutting tool of claim 10, wherein at least one of the first or second plurality of non-planar cutting elements has a first shape and at least one other of the first or second plurality of non-planar cutting elements has a second, different shape.

14. The cutting tool of claim 10, wherein at least one of the first or second plurality of non-planar cutting element has a first diameter and at least one other of the first or second plurality of non-planar cutting elements has a second, different diameter.

15. The cutting tool of claim 10, the first plurality of non-planar cutting elements and the second plurality of non-planar cutting elements being positioned on the leading edges of the plurality of blades.

16. A cutting tool, comprising:

a tool body;

a plurality of blades extending from the tool body; and a first plurality of non-planar cutting elements and a second plurality of non-planar cutting elements on each of the plurality of blades, the first and second pluralities of non-planar cutting elements forming a cutting profile, in a rotated view of the first and second pluralities of non-planar cutting elements into a single plane, the cutting profile including a cone region, a nose region, a shoulder region, and a gage region, the first plurality of non-planar cutting elements having a first diameter, and the second plurality of non-planar cutting elements having a second diameter, the first diameter being different from the second diameter, the first plurality of non-planar cutting elements located in at least the cone region, but not the shoulder region or the gage region, and the second plurality of non-planar cutting elements located in at least one of the nose region, the shoulder region and the gage region, but not the cone region.

17. The cutting tool of claim 16, wherein the first plurality of non-planar cutting elements are only in the cone region and the second plurality of non-planar cutting elements are only in the nose region, the shoulder region and the gage region.

18. The cutting tool of claim 16, wherein the first plurality of non-planar cutting elements are only in the cone region and the nose region, and the second plurality of non-planar cutting elements are only in the shoulder region and the gage region.

19. The cutting tool of claim 16, wherein at least one of the first or second plurality of non-planar cutting elements has a first shape and at least one other of the first or second plurality of non-planar cutting elements has a second, different shape.

20. The cutting tool of claim 16, wherein at least one of the first or second plurality of non-planar cutting elements is blunt and at least one other of the first or second plurality of non-planar cutting elements is sharp.

21. A cutting tool, comprising:

a tool body;

a plurality of blades extending from the tool body; and a plurality of non-planar cutting elements on the leading edge of each of the plurality of blades, the plurality of non-planar cutting elements forming a cutting profile, in a rotated view of the plurality of non-planar cutting elements into a single plane, the cutting profile including a cone region, a nose region, a shoulder region, and a gage region, the plurality of non-planar cutting elements comprising a first material property in at least the cone region but not in either the shoulder region or the gage region, and a second, distinct material property in at least one of the nose region, shoulder region and the gage region, but not in the cone region, wherein a difference between the first and second material properties is at least one of a different diamond grain size, diamond content, diamond sintering process, post-sintering treatment, or binder composition.

22. The cutting tool of claim 21, wherein the plurality of non-planar cutting elements possess greater wear and/or abrasion resistance in the gage region as compared to the cone region.

23. The cutting tool of claim 21, wherein the plurality of non-planar cutting elements possess greater wear and/or abrasion resistance in the shoulder region as compared to the cone region.

24. The cutting tool of claim 21, wherein the plurality of non-planar cutting elements possess greater wear and/or abrasion resistance in the shoulder region as compared to the nose region.

* * * * *